US006559732B2

(12) United States Patent
Makino et al.

(10) Patent No.: US 6,559,732 B2
(45) Date of Patent: May 6, 2003

(54) NONRECIPROCAL CIRCUIT DEVICE WITH MAIN SURFACES OF THE FERRITE AND MAGNET PERPENDICULAR TO THE MOUNTING SUBSTRATE

(75) Inventors: Toshihiro Makino, Matto (JP); Seigo Hino, Kanazawa (JP); Hiroshi Asai, Nagaokakyo (JP); Takekazu Okada, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/883,736

(22) Filed: Jun. 14, 2001

(65) Prior Publication Data

US 2002/0033742 A1 Mar. 21, 2002

(30) Foreign Application Priority Data

| | | |
|---|---|---|
| Jun. 14, 2000 | (JP) | 2000-179059 |
| Oct. 16, 2000 | (JP) | 2000-315330 |
| Feb. 22, 2001 | (JP) | 2001-046951 |

(51) Int. Cl.[7] ..... H01P 1/36
(52) U.S. Cl. ..... 333/1.1; 333/24.2
(58) Field of Search ..... 333/1.1, 24.2

(56) References Cited

U.S. PATENT DOCUMENTS

| | | | | | |
|---|---|---|---|---|---|
| 4,016,510 | A | * | 4/1977 | Hodges et al. | 333/24.2 |
| 4,210,886 | A | * | 7/1980 | Enderby et al. | 333/24.2 |
| 5,068,629 | A | * | 11/1991 | Nishikawa et al. | 333/1.1 |
| 5,159,294 | A | * | 10/1992 | Ishikawa et al. | 333/1.1 |
| 5,226,220 | A | * | 7/1993 | Gevas et al. | 336/96 X |

FOREIGN PATENT DOCUMENTS

| | | | | | |
|---|---|---|---|---|---|
| GB | 2354885 | A | | 4/2001 | |
| GB | 2361361 | A | | 10/2001 | |
| JP | 03074901 | A | * | 3/1991 | H01P/1/383 |
| JP | 03206701 | A | * | 9/1991 | H01P/1/383 |
| JP | 2000156601 | A | | 6/2000 | |

* cited by examiner

*Primary Examiner*—Justin P. Bettendorf
(74) *Attorney, Agent, or Firm*—Keating & Bennett, LLP

(57) ABSTRACT

A nonreciprocal circuit device miniaturized entirely by reducing the height and the weight can prevent characteristic deterioration. In the nonreciprocal circuit device, a ferrite assembly is formed by winding a quadrangular ferrite plate with insulated copper wires mutually intersecting. The ferrite assembly is arranged perpendicularly to the mounting surface of a mounting substrate. On each side of the ferrite assembly, there is arranged a magnet applying a static magnetic field perpendicularly to main surface of the ferrite plate.

20 Claims, 14 Drawing Sheets

NONRECIPROCAL CIRCUIT DEVICE WITH MAIN SURFACES OF THE FERRITE AND MAGNET PERPENDICULAR TO THE MOUNTING SUBSTRATE

BACKGROUND OF THE INVENTION

1. Field of the Invention

The present invention relates to nonreciprocal circuit devices such as isolators and circulators used at microwave frequencies and communication apparatuses incorporating the same.

2. Description of the Related Art

Conventionally, a lumped-constant circulator is formed by containing a plurality of mutually intersecting central conductors arranged near a ferrite plate and a magnet for applying a DC magnetic field to the ferrite plate in a case. An isolator is formed by arranging a terminating resistor at a predetermined port of three ports included in the circulator.

Specifically, the central conductors are connected to each other at a connecting portion having the same shape as the bottom of the ferrite plate. The ferrite plate is placed on the connecting portion. Three central conductors extended from the connecting portion are bent to enclose the ferrite plate at angles of approximately 120 degrees with respect to each other. This structure constitutes a ferrite assembly. The ferrite assembly is contained together with matching capacitors and the terminating resistor in a resin case. The resin case and the permanent magnet are enclosed by upper and lower box-like yokes formed of a magnetic metal to constitute an isolator.

With the increasingly reduced sizes and weights of the recent mobile communication apparatuses, there has also been a growing demand for the size (including height) and weight reductions of components used in the apparatuses. Nonreciprocal circuit devices are not exceptional. In a conventional nonreciprocal circuit device, components constituting the device are stacked on a mounting surface of a substrate. Thus, in order to reduce the size and height of the entire device, the thickness of the components have been reduced.

For example, when assuming that the thickness of a ferrite plate is 0.3 mm, the thickness of a permanent magnet is 0.5 mm, the thickness of a yoke and a substrate is 0.2 mm, respectively, and the thickness of each central conductor is 0.05 mm, two central conductors intersecting each other on the top and bottom of the ferrite plate, the thickness of the entire device is 1.6 mm, resulting from a simple calculation by an equation $0.3+0.5+0.2\times2+0.2+0.05\times4=1.6$. However, according to the recent market demand, the thickness of the nonreciprocal circuit device has been required to be 1.5 mm or less. In order to meet the market demand, for example, when the thickness of the ferrite plate or the permanent magnet is reduced, a desired static magnetic field intensity cannot be obtained and the electric characteristics of the device is thereby inevitably deteriorated.

SUMMARY OF THE INVENTION

Accordingly, it is an object of the present invention to provide a nonreciprocal circuit device capable of reducing the size, height, and weight, while preventing deterioration of the electric characteristics of the device. It is another object of the invention to provide a communication apparatus incorporating the nonreciprocal circuit device.

According to a first aspect of the present invention, there is provided a nonreciprocal circuit device including a plurality of central conductors mutually intersecting in an electrically insulated state, a ferrite assembly including the central conductors and a ferrite member, and at least one magnet arranged for applying a static magnetic field to the ferrite member, in which main surfaces of the ferrite member and the magnet are arranged perpendicularly to a mounting surface of a substrate. With this arrangement, since the thickness direction of each of the components constituting the nonreciprocal circuit device is oriented toward the direction parallel to the mounting surface of the substrate. Thus, without the need for making the components thinner forcefully, the entire nonreciprocal circuit device can be miniaturized reducing its height.

In addition, this nonreciprocal circuit device may further include a yoke composed of planar portions contacted with the external surfaces of a pair of magnets or a pair of a magnet and a magnetic member arranged with the ferrite assembly sandwiched therebetween and another planar portion bridging the planar portions. With this arrangement, a predetermined static magnetic field can be applied to the ferrite member even when the magnets are small. Thus, while preventing deterioration of the electric characteristics of the device, the entire device can be miniaturized.

In addition, in this nonreciprocal circuit device, the bridging planar portion may define substantially a plane. As a result, since the weight of the yoke is reduced, the weight of the entire device can also be reduced and cost reduction can be achieved. In addition, with this arrangement, since the static magnetic field generated by the magnets does not bend, it can be applied perpendicularly to the ferrite member in a manner that the magnetic field is uniformly distributed.

In addition, in the nonreciprocal circuit device at least one hole is provided in the yoke, the hole being formed near the ferrite member. For example, the hole may be provided in the planar portion of the yoke parallel or perpendicular to the mounting substrate, or may be extended from the planar portion parallel to the substrate to the planar portions perpendicular to the substrate. This structure can prevent the static magnetic field generated by the magnets from being bent due to the yoke. Then, the static magnetic field can be applied perpendicularly to the ferrite member in the manner that the magnetic field distribution is uniformly provided.

Furthermore, in this reciprocal circuit device, the opening of the hole may define a substantially quadrangle shape. With this arrangement, the small opening area can more increase the effect of prevention of the bending of the static magnetic field given by the hole.

Furthermore, in the nonreciprocal circuit device, the hole may be formed such that the dimension of a projected planar form of the hole in a direction perpendicular to the main surfaces of the ferrite member includes the gap between the magnets or the gap between the magnet and the magnetic member sandwiching the ferrite assembly, and the dimension of a projected planar form of the hole in a direction parallel to the main surfaces of the ferrite member includes the width of the ferrite member in the direction parallel to the main surfaces. In this arrangement, without making the opening size of the hole larger than necessary, the effect of prevention of the bending of the static magnetic field given by the hole improves.

In addition, in this nonreciprocal circuit device, the yoke may be used as a case and the hole may be covered with a nonmagnetic film. Or, the yoke may be filled with a resin. With this arrangement, the case can be more dust-proof and damp-proof. Moreover, this prevents problems such as open circuitry and short circuit, when performing reflow soldering, the soldered parts of metal wires are melted and the metal wires result in floating.

In addition, the nonreciprocal circuit device may further include a cavity or a hole formed in the planar portion of the yoke which is parallel to the mounting substrate or in the mounting substrate to fit the ferrite assembly or each magnet thereinto. In this arrangement, since the ferrite assembly or the magnets can be easily fixed inside the nonreciprocal circuit device, any special members for fixing the components are not required.

In addition, in this nonreciprocal circuit device, the ferrite member may have a polygonal planar shape with four or more sides. Accordingly, the ferrite assembly can be easily fixed inside the device and also the entire device can be miniaturized reducing the height.

In addition, the central conductors may be metal wires having electrically insulated surfaces, and the ferrite member may be wound with the central conductors to constitute the ferrite assembly. In this arrangement, even when using a compact ferrite member, the inductance of the central conductors can be sufficiently provided.

Furthermore, in this nonreciprocal circuit device, the diameter of each metal wire may be 0.1 mm or less. In this case, without increasing the insertion loss, the nonreciprocal circuit device can be miniaturized.

Furthermore, the central conductors may be metallic foils and the ferrite member may be wound with the central conductors to form the ferrite assembly. In this arrangement, since the ferrite assembly is made thinner, the entire device can be made compact.

Furthermore, this nonreciprocal circuit device may have two central conductors, one end of each conductor being grounded and the other end of the conductors being connected to input/output terminals or components connected to the input/output terminals. In this arrangement, for example, unlike a case in which three central conductors are provided to connect an impedance matching circuit to a third central conductor, no impedance circuit depending on a frequency is arranged. Accordingly, wider band characteristics can be obtained.

In addition, the thickness of the yoke may be 0.2 mm or less. As a result, without reducing vibration resistance strength and fall-shock tolerance strength, the entire device can be miniaturized while reducing the height of the device.

According to a second aspect of the invention, there is provided a communication apparatus including the nonreciprocal circuit device of the invention. For example, the nonreciprocal circuit device is arranged in the output section of a transmission signal amplifying circuit.

DESCRIPTION OF THE PREFERRED EMBODIMENTS

With reference to FIGS. 1 to 4, a description will be given of the structure of an isolator according to a first embodiment of the present invention.

Figure 1:
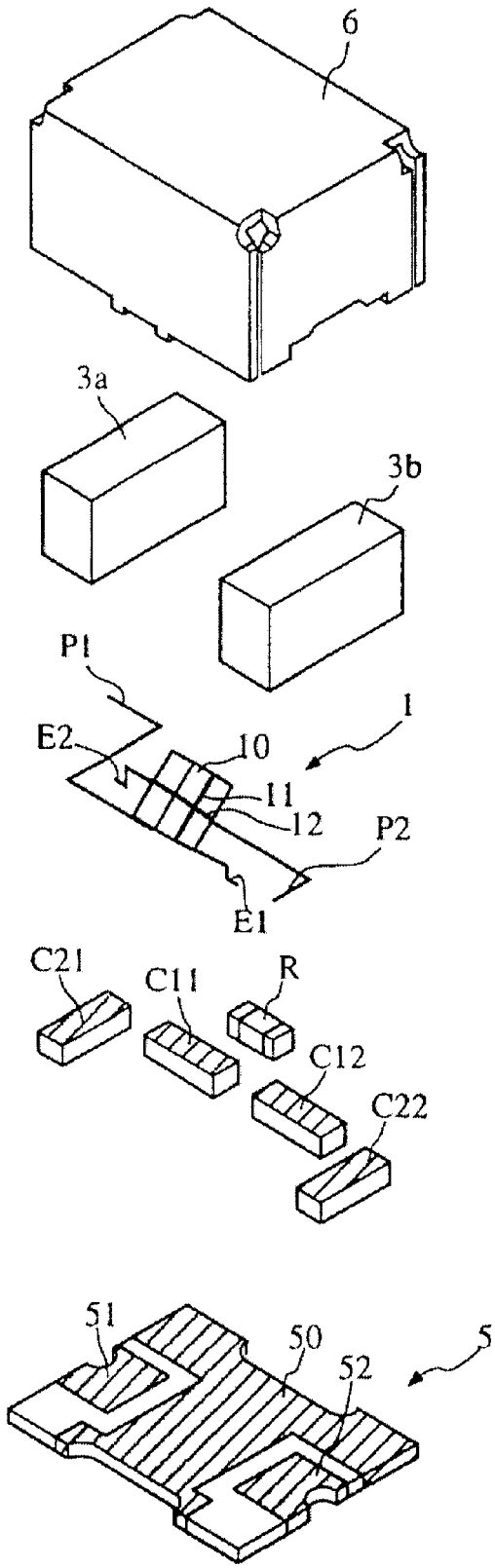
FIG. 1 shows an exploded perspective view of an isolator according to a first embodiment of the present invention.

FIG. 1 shows an exploded perspective view of the isolator. In this figure, the reference numeral 1 denotes a ferrite assembly formed by winding a ferrite member 10 with a first central conductor 11 and a second central conductor 12 composed of insulated copper wires. One end E1 of the first central conductor 11 is grounded and the other end P1 thereof is electrically connected to capacitors C11 and C21, which will be described below. In addition, one end E2 of the second central conductor 12 is grounded and the other end P2 thereof is connected to capacitors C12 and C22.

The reference numerals 3*a* and 3*b* denote permanent magnets applying a static magnetic field to the ferrite member 10. The reference numeral 6 denotes a yoke constituting a magnetic circuit. The yoke is also used as a case. The reference numeral 5 denotes a substrate for mounting components. On the upper surface of the substrate, there are arranged a grounding electrode 50, an input terminal electrode 51, and an output terminal electrode 52. Some of these electrodes are extended to part of the lower surface of the mounting substrate 5 from the end surfaces thereof to use as terminal electrodes when the isolator is surface-mounted on the circuit board of an electronic apparatus. The capacitors C11, C12, C21, and C22 are chip capacitors. The reference numeral R denotes a chip resistor. The chip capacitor C21 is mounted on the input terminal electrode 51 and the chip capacitor C22 is mounted on the output terminal electrode 52. The chip capacitors C11 and C12 are mounted on the grounding electrode 50. The chip resistor R is mounted in a manner bridging the upper-surface electrodes of the chip capacitors C11 and C12.

Figure 2:
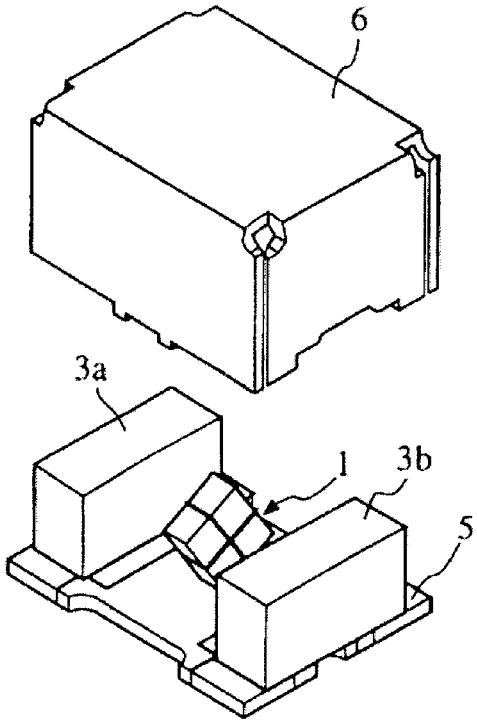
FIG. 2 shows a perspective view of the isolator in an assembling process.

FIG. 2 shows a perspective view of the nonreciprocal circuit device shown in FIG. 1 in a process assembling the components of the device. In this figure, on the substrate 5 there are mounted capacitors and a resistor. Then, the ferrite assembly 1 is attached to the substrate with an adhesive, such as an epoxy resin, a thermosetting resin, an ultraviolet-setting resin, or the like. Then, the magnets 3*a* and 3*b* are mounted on the substrate 5. In FIG. 2, the capacitors C11, C12, C21, and C22, and the resistor R shown in FIG. 1 are not shown. In the situation shown in FIG. 2, the top part of the substrate 5 is covered by the yoke 6 as a case, and the yoke 6 is soldered to the grounding electrode 50 on the substrate 5 to constitute the isolator.

Figure 3:
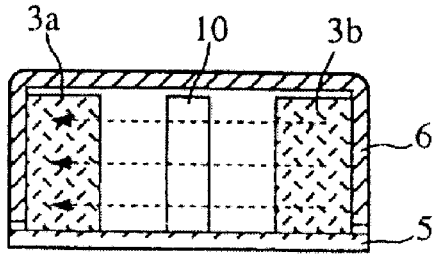
FIG. 3 shows a longitudinal cross-sectional view of the isolator.

FIG. 3 shows a longitudinal cross-sectional view along a plane passing the two magnets and the ferrite member. The central conductors, the capacitors, and the resistor are omitted in this figure. Broken-line arrows in the figure indicate the direction of a magnetic field. As shown here, the magnetic field passes in a direction parallel to the substrate 5, that is, in a direction perpendicular to main surfaces of the ferrite member 10. The ferrite member 10 is arranged inside the space of a magnetic circuit composed of the magnets 3*a* and 3*b* and the yoke 6. In this structure, the magnets 3*a* and 3*b*, the ferrite member 10, and the central conductors are arranged in the direction parallel to the substrate 5, that is, in a direction parallel to the mounting surface thereof. Thus, the entire height of the isolator can be reduced.

Figure 4:
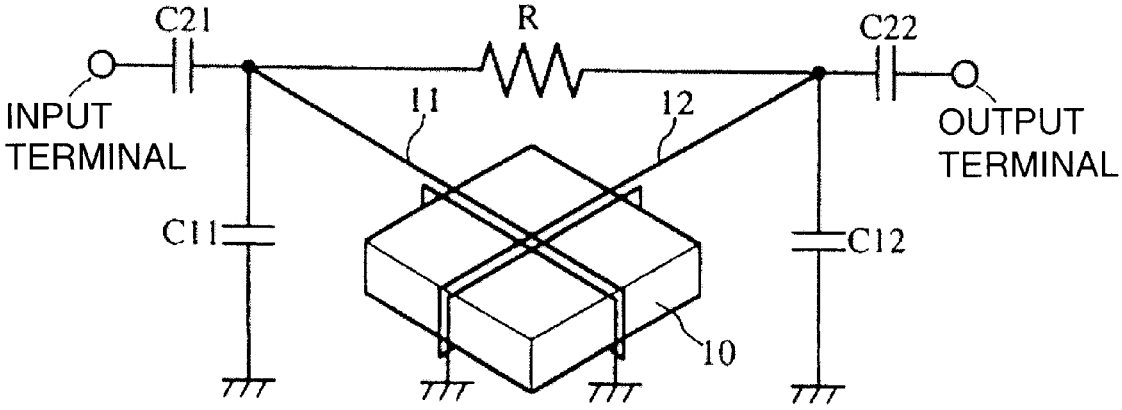
FIG. 4 shows an equivalent circuit diagram of the isolator.

FIG. 4 shows a circuit diagram of the isolator. One end of each of the central conductors 11 and 12 is grounded. The capacitor C21 is connected in series between the other end of the central conductor 11 and an input terminal and the capacitor C22 is connected in series between the other end of the central conductor 12 and an output terminal. The capacitor C11 is connected in parallel between the other end of the central conductor 11 and a ground. The capacitor C12 is connected in parallel between the other end of the central conductor 12 and a ground. Furthermore, the resistor R is connected between the other ends of the central conductors 11 and 12.

Now, when signals are sent in the forward direction, both ends of the resistor R have the same phase and the same amplitude. As a result, no current flows through the resistor R and, input signals supplied to the input terminal are simply output from the output terminal.

When signals are sent in the opposite direction, the direction of a high frequency magnetic field passing through the ferrite member 10 is opposed to that in the forward direction. As a result, since signals having opposite phases are generated at both ends of the resistor R, the resistor R consumes electrical power. Thus, theoretically, the input terminal does not output any signal. Practically when signals are transmitted in the forward direction and in the opposite direction, respectively, a phase difference between both ends of the resistor varies according to the intersection angle the central conductors 11 and 12 and the rotation angle of a polarized wave surface based on Faraday rotation. As a result, the intensity of the static magnetic field applied to the ferrite member 10 and the angle at which the central conductors 11 and 12 intersect each other are determined such that the insertion loss in the isolator is small and excellent nonreciprocal (isolation) characteristics can be obtained.

The above operation requires a premise in which matching between the input/output impedance and the isolator impedance should be obtained. However, when the size of the ferrite member 10 is reduced, since the lengths of the central conductors 11 and 12 are reduced, the inductance components of the central conductors are smaller. Thus, when the isolator is operated at a desired frequency, the impedance matching cannot be obtained suffciently.

In order to solve the problem, the ferrite member 10 is wounded with the central conductors 11 and 12. Consequently, even when using a compact ferrite plate, the inductances of the central conductors can be increased so that the operational frequency band is broadened. However, the inductances sharply increase by winding the central conductors around the ferrite member 10. Thus, only with the use of the capacitors C11 and C12 connected in parallel, it is difficult to obtain the impedance matching, and the inductances are higher than a normalized impedance of 50 Ω. Therefore, the capacitors C21 and C22 having predetermined capacitances are connected in series to the input/output terminals.

The central conductors 11 and 12 are copper wires in which the surfaces of the wires are coated with electrically insulating films. The insulating coating film is, for example, formed of polyimide, polyamide-imide, polyester-imide, polyester, polyurethane, or the like. The diameter of each copper wire is set to be 0.1 mm or less.

Although the copper wires are used as the central conductors of the above embodiment, other kinds of metal wires may be used. As an alternative to copper, there may be used wires formed of silver, gold, or any other metal, or wires formed of alloy including any of silver, gold, or other metals.

In order to reduce the dimensions and weight of a nonreciprocal circuit device, usually, components constituting the device need to be as small as possible. On the other hand, when the diameters of central conductors are reduced, electric resistance increases. Consequently, the insertion loss of the device increases. Thus, an experiment was conducted to examine the relationship between the diameter length of the central conductor and the insertion loss. While increasing the diameter length of the central conductor from 0.03 mm gradually, the insertion loss in the 1 GHz band was measured. The effects of insertion loss improvement obtained by increasing the diameter of the central conductor could be found until the diameter length was increased up to 0.1 mm at maximum. Then, it was obvious that there could be seen almost no improvement when the diameter became longer than that. Therefore, when setting the diameter length of the central conductor to be approximately 0.1 mm or less, without deteriorating the insertion loss, the isolator can be miniaturized and its height can thereby be reduced.

The yoke 6 is formed of a metal including iron as a main component. When simply using an iron yoke, the yoke has a high electric resistivity. Thus, the surface of the yoke is plated with a metal film having a high conductivity such as silver. As a result, the effect of shielding is enhanced and the insertion loss of the isolator can be reduced.

In addition, Cu strike plating, Ni plating, and Ag plating are performed onto the iron plate. After the Cu strike plating is performed, the Ni plating is performed as a base plating, and finally, the Ag plating is performed to complete the plating process. In this case, the Ni layer acts as a barrier preventing the corrosion of silver caused by soldering and the like. Since Ni has a corrosion resistance higher than those of Cu and Ag, the Ni layer can play a rust-prevention role against the yoke (case).

In order to miniaturize the device, it is also effective to reduce the thickness of the yoke. However, mechanical strength could be deteriorated. Thus, an experiment was conducted to examine the relationship between the thickness of the yoke, vibration resistance strength, and fall-shock tolerance strength. The experiment showed that when the thickness of the yoke was increased from 0.05 mm gradually to measure the vibration resistance strength and the fall-shock tolerance strength, the effects of improvement of the vibration resistance strength and the fall-shock tolerance strength obtained by increasing the thickness of the yoke were found until the thickness was 0.2 mm, and almost no effect could be found when the thickness was greater than that. Therefore, when the thickness of the yoke is approximately 0.2 mm or less, while maintaining the vibration resistance strength and the fall-shock tolerance strength, the isolator can be miniaturized and its height can be reduced.

In the above embodiment, the ferrite assembly 1 and the magnets 3*a* and 3*b* as the components of the nonreciprocal circuit device are arranged horizontally to the mounting surface of the substrate and there is arranged no yoke on the bottom of the isolator. As a result, the number of components overlapping in a direction perpendicular to the mounting surface can be reduced. In addition, since the position in which the central conductors 11 and 12 intersect each other is present on a side surface of the ferrite member 10, the intersecting part has no influence on the height of the isolator. Thus, the height of the isolator can be reduced. For example, when a diagonal length of the ferrite member 10 (the length in the direction perpendicular to the mounting surface) is 1.0 mm, the thickness of a planar portion of the yoke 6 is 0.2 mm, and the thickness of the substrate 5 is 0.2 mm, the entire thickness of the isolator is 1.4 mm from the simple calculation. This can meet the recent market demand, in which the thickness needs to be less than 1.5 mm.

Furthermore, since the central conductors are composed of insulation-coated copper wires, there is no need for an insulation sheet conventionally required for insulating the central conductors. Thus, the cost of an insulating member and cost for attaching the member are unnecessary. In addition, since no insulation failure is caused by deviation in the arrangement of an insulating member, the nonreciprocal circuit device of the embodiment can be manufactured in a stable manner. As a result, product quality can be enhanced when manufacturing such devices. Moreover, the central conductors (copper wires) can be bent easily. Even when the arrangements of capacitors and a resistor are slightly changed, only by adjusting the position, angle, and lengths used for bending the central conductors (copper wires), the same central conductors and the same ferrite assembly can be applied. Thus, since the same components can be used even in some different designs, cost reduction can be achieved.

Next, the structure of an isolator according to a second embodiment of the invention will be discussed with reference to FIGS. 5A to 5D.

Figure 5A:
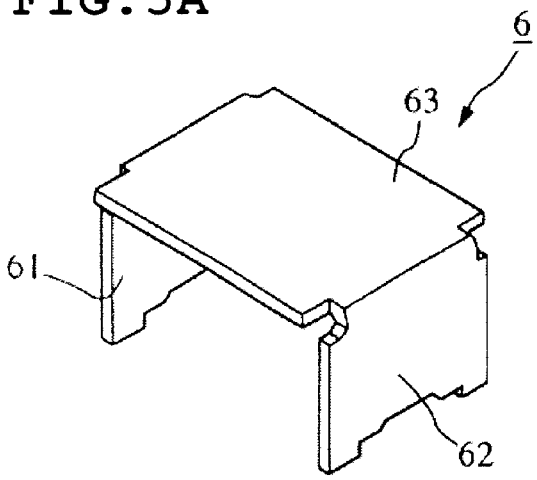
FIGS. 5A and 5C show perspective views illustrating the main part of an isolator according to a second embodiment of the invention and FIGS. 5B and 5D show transversal cross-sectional views illustrating the main part of the isolator.
Figure 5C:
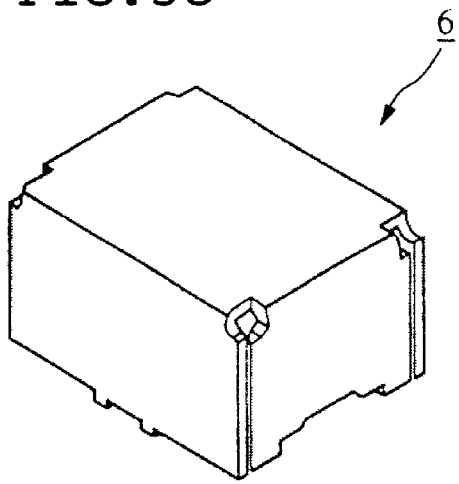
Figure 5B:
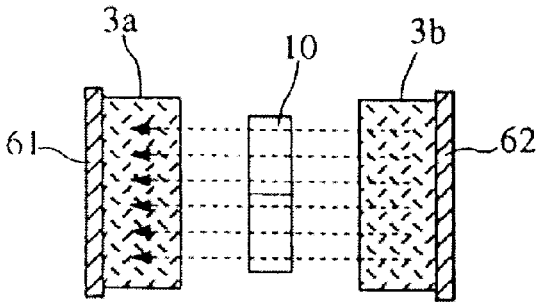

FIG. 5A shows a perspective view of a yoke used in the isolator and FIG. 5B shows a transversal cross-sectional view cut at substantially the central part of the isolator. For comparison, FIG. 5C shows a perspective view of the yoke of the first embodiment and FIG. 5D shows a transversal cross-sectional view cut at the central height of the yoke.

In FIGS. 1 and 2, the yoke 6 is composed of the five planar portions. However, in the second embodiment, the yoke 6 is composed of three planar portions indicated by the reference numerals 61, 62, and 63. As shown in FIGS. 5A and 5B, the two planar portions 61 and 62 of the yoke 6 are in contact with the external surfaces of magnets 3*a* and 3*b*. The planar portion 63 bridges the planar portions 61 and 62 in a manner forming substantially one plane connecting the portions 61 and 62.

Figure 5D:
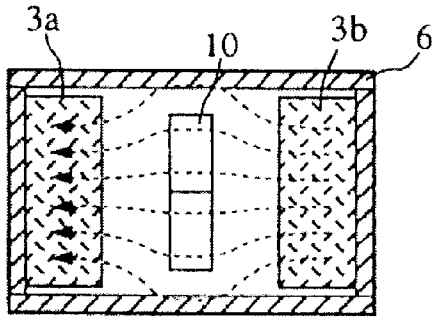

In FIGS. 5B and 5D, broken-line arrows indicate one example of magnetic field distribution. In the structure shown in FIG. 5D as the comparison example, the remaining planar portions of the yoke are present in directions perpendicular to the planar portions in contact with the external surfaces of the magnets 3*a* and 3*b*. Thus, since the magnetic field expands, the direction of the static magnetic field applied to the ferrite member 10 is bent and the intensity of the static magnetic field is reduced. As a result, in this case, the magnets need to be much greater than the size of the ferrite member 10. This hinders the miniaturization of the isolator. In contrast, in the structure shown in FIG. 5B, there is provided no planar portion of the yoke in the direction perpendicular to the planar portions 61 and 62 in contact with the external surfaces of the magnets 3*a* and 3*b*. Thus, the magnetic field does not expand and the intensity of the magnetic field does not decrease. Accordingly, the static magnetic field can be applied in the direction perpendicular to the main surfaces of the ferrite member 10 in a manner distributing the magnetic field uniformly. This is because aerial portions have magnetic resistance higher than the iron yoke. As a result, this can prevent the deterioration of electric characteristics of the nonreciprocal circuit device caused when the magnetic field is not uniformly distributed with the use of compact magnets. Thus, small magnets can be used. With this arrangement, since the height of the entire device can be reduced and magnetic power can be efficiently used, operations at high frequencies, which used to be impossible due to the insufficiency of magnetic power, can be performed. In addition, since the weight of the yoke can be reduced, the weight of the entire device can also be reduced. Moreover, the material cost of the yoke can be lower, which leads to cost reduction at the same time.

Next, the structure of an isolator according to a third embodiment of the invention will be discussed with reference to FIGS. 6A to 6C.

Figure 6A:
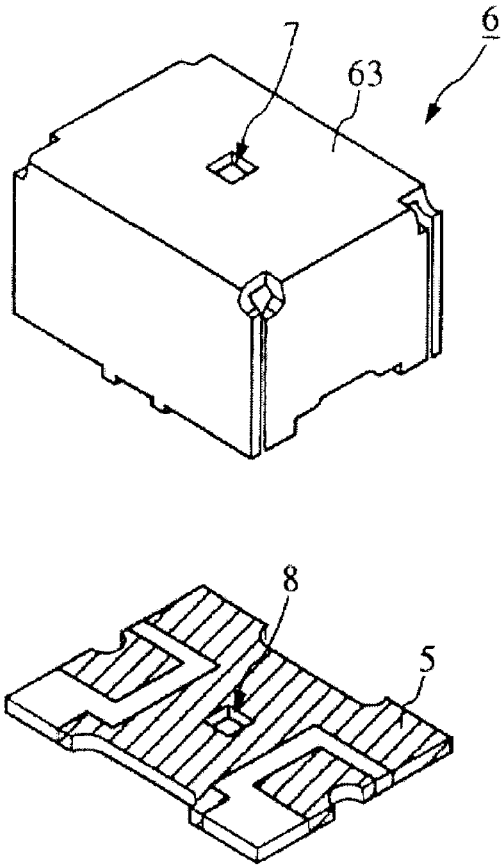
FIG. 6A shows an exploded perspective view illustrating the main part of an isolator according to a third embodiment of the invention.
Figure 6B:
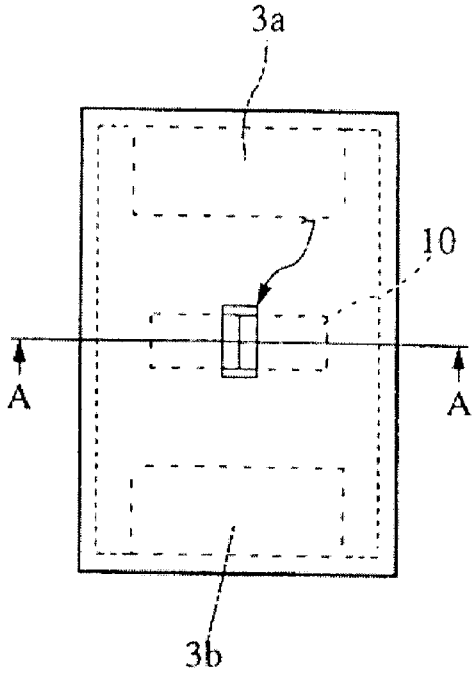
FIG. 6B shows a top view of the main part.
Figure 6C:
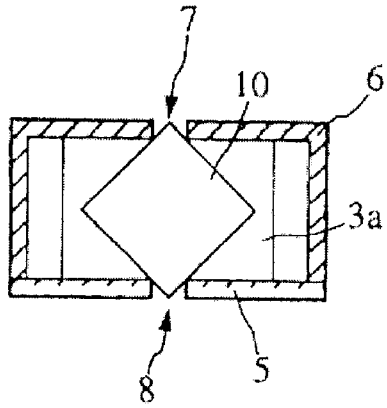
FIG. 6C shows a longitudinal cross-sectional view of the main part.

FIG. 6A shows an exploded perspective view for illustrating the structures of a yoke and a substrate as components constituting the isolator. FIG. 6B shows a top view of the isolator, and FIG. 6C shows a longitudinal cross-sectional view along a line A—A shown in FIG. 6B.

As shown in FIG. 6A, a hole 7 is formed in the center of a planar portion 63 on the top surface of a yoke 6. Another hole 8 is formed in the center of a substrate 5. When a ferrite member 10 is arranged in a space formed by the substrate 5 and the yoke 6, as shown in FIG. 6B, a corner of the ferrite member 10 is fitted into the hole 8 of the substrate 5 and another corner opposite thereto is fitted into the hole 7 of the yoke 6. The ferrite member 10 is fixed at the center position between the magnets 3*a* and 3*b* such that the main surfaces of the ferrite member 10 are set perpendicular to the substrate 5 and in parallel to the main surfaces of the magnets 3*a* and 3*b*. Central conductors winding around the ferrite member 10 are omitted in these figures.

The ratio of the thickness of each of the yoke and the substrate with respect to the thickness of the isolator is small, approximately 10%. However, still, due to the strong market demand for height reduction, the heights of all of the components included in the device need to be reduced. In this embodiment, since the ferrite member 10 is fitted into the ceiling surface of the yoke 6 and the mounting substrate 5, the height of the isolator can be reduced by the total thickness (approximately 0.4 mm) of the yoke 6 and the substrate 5 at maximum. In addition, since the corners of the ferrite member 10 are fitted into the yoke 6 and the substrate 5, without deteriorating the electric characteristics, the height reduction can be achieved.

In this embodiment, the holes for fitting the ferrite member 10 of the ferrite assembly 1 are formed in the substrate 5 and the yoke 6. However, holes for fitting the corners of the magnets 3*a* and 3*b* may be formed in the substrate and the yoke. In addition, the holes for fitting the ferrite member or the magnets may be cavities instead of through-holes.

Figure 7:
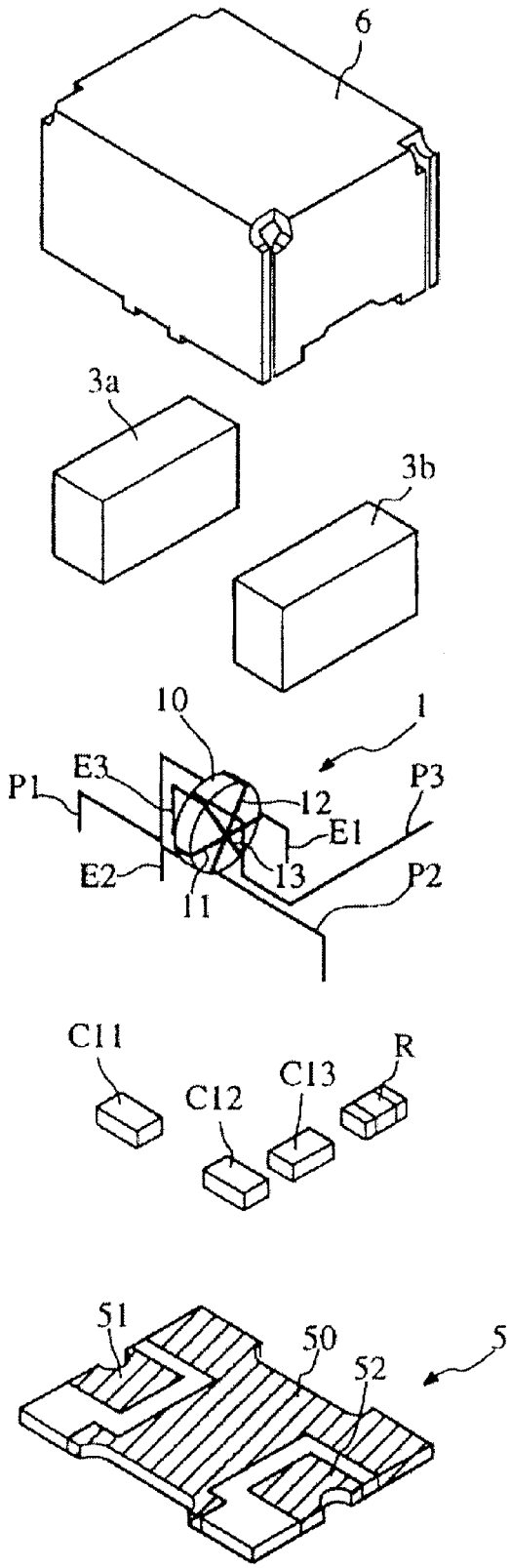
FIG. 7 shows an exploded perspective view illustrating an isolator according to a fourth embodiment of the invention.

Next, the structure of an isolator according to a fourth embodiment of the invention will be discussed with reference to FIGS. 7 and 8. FIG. 7 shows an exploded perspective view of the isolator and FIG. 8 shows an equivalent circuit diagram of the isolator.

In each of the embodiments described above, the ferrite assembly 1 is formed by winding the quadrangle ferrite plate with the two central conductors. However, in the isolator of the fourth embodiment, a disk-shaped ferrite member 10 is wound with three central conductors 11, 12, and 13 intersecting each other at angles of 120 degrees. One-side ends of the three central conductors 11, 12, and 13 are grounding portions E1, E2, and E3 and the other-side ends thereof are ports P1, P2, and P3. The grounding portions E1, E2, and E3 are connected to a grounding electrode 50 formed on a substrate 5. The port P1 is connected to the upper surface electrode of a capacitor C11 and an input terminal electrode 51 on the substrate 5. The port P2 is connected to the upper surface electrode of a capacitor C12 and an output terminal electrode 52 on the substrate 5. The port P3 is connected to the upper surface electrode of a capacitor C13 and a one-side electrode of a resistor R.

The lower surface electrode of each of the capacitors C11, C12, and C13 is electrically connected to the grounding electrode 50 on the substrate 5. The resistor R is arranged on the substrate 5 in a manner that the one-side electrode of the resistor R is electrically connected to the grounding electrode 50, and the other-side electrode thereof is electrically connected to the upper surface electrode of the capacitor C13. The arrangements of other components including the magnets 3*a* and 3*b*, the yoke 6, and the like, are the same as those shown in the above embodiments.

Figure 8:
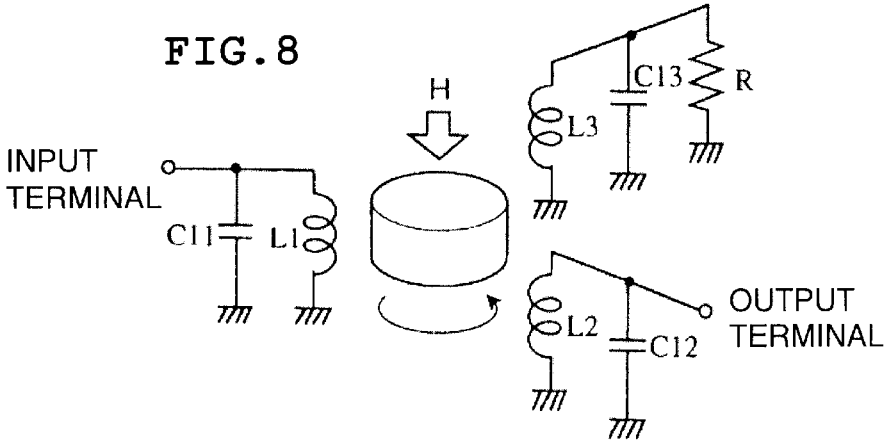
FIG. 8 shows an equivalent circuit diagram of the isolator of the fourth embodiment.

This structure constitutes the equivalent circuit shown in FIG. 8. In FIG. 8, the reference characters L1, L2, and L3 denote inductances of the central conductors. The reference characters C11, C12, and C13 denote matching capacitors, and the reference character R denotes a terminating resistor. With this arrangement, the isolator of the fourth embodiment is formed by disposing a termination resistor at one of the three ports of a circulator to constitute the isolator.

Figure 9:
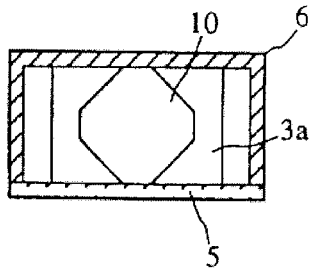
FIG. 9 shows a longitudinal cross-sectional view illustrating the main part of an isolator according to a fifth embodiment of the invention.

Next, the structure of an isolator according to a fifth embodiment of the invention will be discussed with reference to FIG. 9. FIG. 9 shows a longitudinal cross-sectional view of the isolator, which is a sectional view in the position equivalent to the part shown in FIG. 6C. However, unlike the structure shown in FIG. 6C, in FIG. 9, the ferrite member 10 is an octagonal plate obtained by chamfering the four corners of a quadrangular plate. A part formed by chamfering is in contact with the upper surface of a substrate 5 and the opposing part is in contact with the inner surface of the yoke 6.

With this arrangement, since the height of the ferrite member 10 is reduced in the direction perpendicular to the mounting surface, the height of the entire isolator can also be reduced. In addition, since only the corners of the ferrite member 10 are chamfered, without deteriorating the electric characteristics, the height can be reduced. Moreover, by chamfering the corners, since the weight of the ferrite member is reduced, the entire isolator can be lightweight.

In each of the above embodiments, on each side of the ferrite member, the permanent magnet is arranged to apply a magnetic field in the direction perpendicular to the main surfaces of the ferrite member. However, alternatively, a permanent magnet may be arranged on one side of the ferrite assembly and a block formed of a magnetic material may be arranged on the other side thereof to allow the block to act as a member of magnetic shunt steel. Like the case in which the permanent magnets are arranged on both sides of the ferrite assembly, in this arrangement, a magnetic field can be applied in a substantially leaner form in the direction perpendicular to the main surfaces of the ferrite member.

Next, the structure of an isolator according to a sixth embodiment of the invention will be discussed with reference to FIGS. 10A to 13D.

Figure 10C:
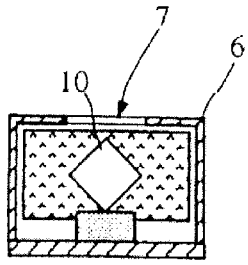
FIG. 10C shows a side sectional view of the isolator.
Figure 10B:
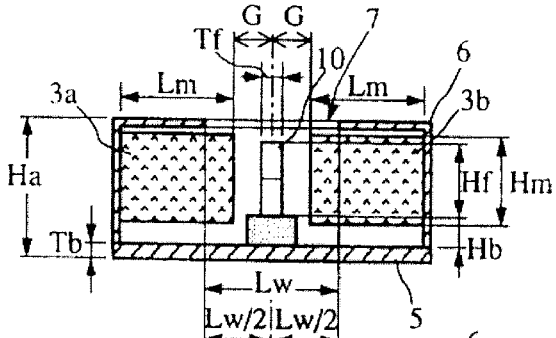
FIG. 10B shows a front sectional view of the isolator.
Figure 10A:
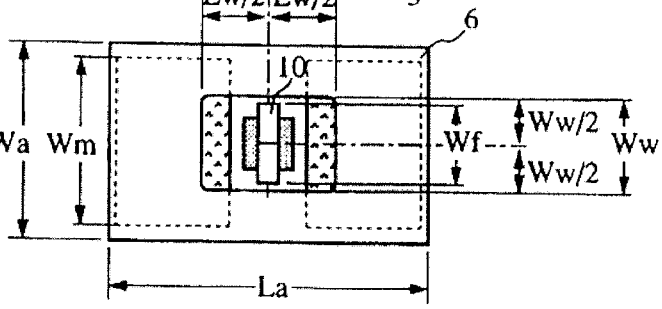
FIG. 10A shows a top view of an isolator according to a sixth embodiment of the invention.
Figure 11A:
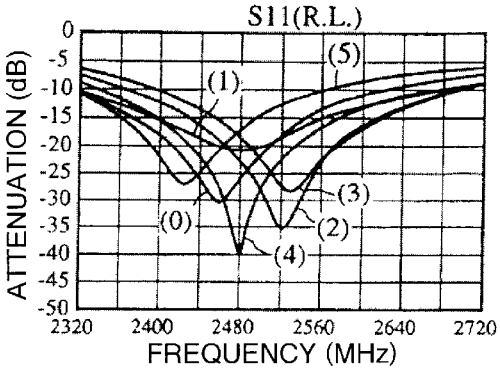
FIGS. 11A to 11D show graphs for illustrating electric characteristics varying with the size of a hole formed in the isolator of the sixth embodiment.
Figure 11C:
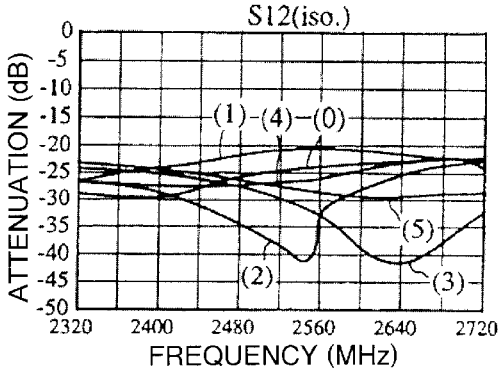
Figure 11B:
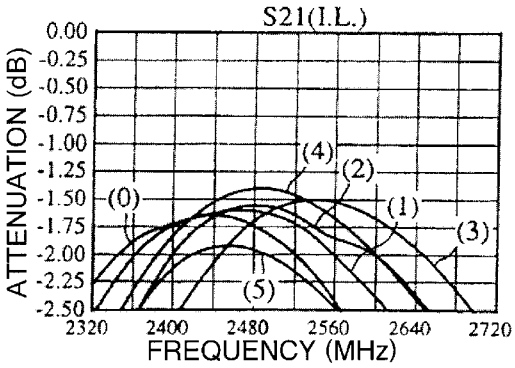
Figure 11D:
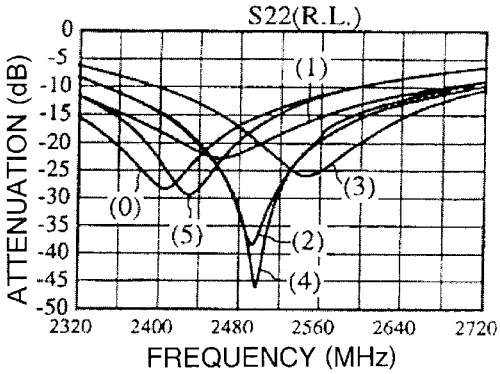
Figure 12A:
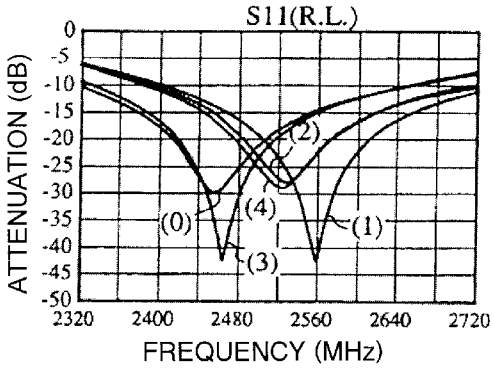
FIGS. 12A to 12D show other graphs for illustrating electric characteristics varying with the size of the hole formed in the isolator of the sixth embodiment.
Figure 12C:
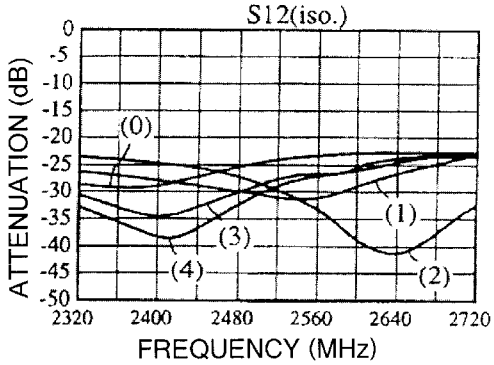
Figure 12B:
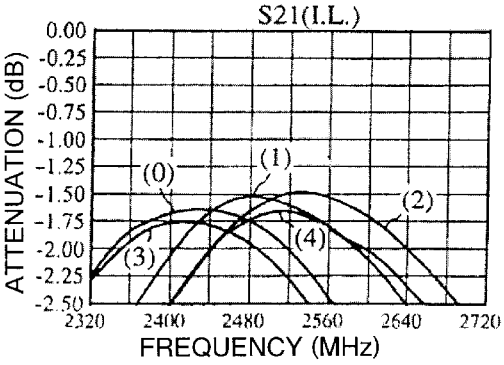
Figure 12D:
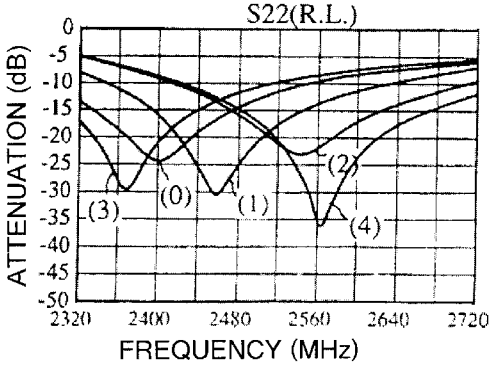

FIG. 10A shows a top view of the isolator, FIG. 10B shows a front section of the isolator, and FIG. 10C shows a side section of the isolator. In these figures, central conductors winding around a ferrite member 10 are omitted. Like the isolator shown in FIGS. 6A to 6C, in the isolator of this embodiment, a hole 7 is formed in the center of the top surface of a yoke 6. The ferrite member 10 is attached to a supporting base disposed on the substrate 5. The hole 7 is not formed to fit the ferrite member 10 thereinto, but the hole 7 is formed to arrange the yoke away from the ferrite member 10.

As mentioned above, by providing the hole 7 near the ferrite member 10 in the yoke 6, a static magnetic field generated by the magnets 3*a* and 3*b* does not bend toward the direction of the upper surface of the yoke 6, being applied perpendicular to the main surfaces of the ferrite member 10, while performing the magnetic field distribution uniformly. This arrangement can increase the intensity of the static magnetic field to be applied to the ferrite member 10 even though the same magnets are used. Thus, property deterioration caused by the insufficiency of magnetism at high frequencies can be prevented. Accordingly, since small magnets can be used in the isolator, the entire isolator can be miniaturized. In addition, since the static magnetic field is applied uniformly to the ferrite member 10, the increase in insertion loss can be prevented.

FIGS. 11A to 11D and FIGS. 12A to 12D show graphs illustrating the property changes obtained when the size of the hole 7 shown in each of FIGS. 10A to 10C changes. In this case, the sizes of parts shown in FIGS. 10A and 10B will be presented as follows:

Wa=2.5 mm, Wm=2.0 mm, La=3.2 mm, Ha=1.6 mm, Hm=0.85 mm, Hf=0.7 mm, Hb=0.4 mm, Tb=0.15 mm, Lm=1.0 mm, Wf=0.7 mm, Tf=0.3 mm, and G=0.45 mm.

FIGS. 11A to 11D show the changes of four S parameters found when the size Ww of the widthwise direction of the hole 7 (direction parallel to the main surfaces of the ferrite member 10) is set to be substantially fixed while changing the size Lw of the lengthwise direction of the hole 7 (direction perpendicular to the main surface of the ferrite member 10).

According to the reference numerals (0) to (5) shown in FIGS. 11A to 11D, the sizes Ww and Lw will be presented below:

| | Ww/2 [mm] | Lw/2 [mm] |
|---|---|---|
| (0) | 0 | 0 |
| (1) | 0.39 | 0.21 |
| (2) | 0.38 | 0.45 |
| (3) | 0.38 | 0.65 |
| (4) | 0.38 | 1.4 |
| (5) | 0.39 | 1.6 + 1.0 |

In the size of Lw/2 in (5) of the above table, "1.0" indicates the size of the side surface of the yoke 6 obtained when the opening of the hole 7 is extended to the side surface of the yoke 6.

By providing the hole 7 as shown above, insertion loss S21 and isolation S12 can be improved. Additionally, since reflection losses S11 and S22 also vary with the size of Lw, it is found that significantly low reflection characteristics can be obtained by setting the value of Lw appropriately.

FIGS. 12A to 12D shows the changes of four S parameters obtained when the size Lw of the lengthwise direction of the hole 7 (direction perpendicular to the main surfaces of the ferrite member 10) is set to be substantially fixed while changing the size Ww of the widthwise direction of the hole 7 (direction parallel to the main surfaces of the ferrite member 10).

According to the reference numerals (0) to (4) shown in FIGS. 12A to 12D, the sizes Ww and Lw will be presented below:

| | Ww/2 [mm] | Lw/2 [mm] |
|---|---|---|
| (0) | 0 | 0 |
| (1) | 0.19 | 0.65 |
| (2) | 0.38 | 0.65 |
| (3) | 1.05 | 0.65 |
| (4) | 1.25 + 0.96 | 0.65 |

In the size of Ww/2 in (4) of the table, "0.96" indicates the size of the side surface of the yoke 6 when the opening of the hole 7 is extended to the side surface of the yoke 6.

By forming the hole 7 as shown above, insertion loss S21 and isolation S12 can be improved. In addition, since reflection losses S11 and S22 also vary with the size of Ww, significantly low reflection characteristics can be obtained by setting the value of Ww appropriately.

FIGS. 13A to 13D show examples provided by changing the opening size of the hole 7. As in FIGS. 11A to 11D and FIGS. 12A to 12D, in this case, changes of the S parameters were obtained by changing the size Ww of the widthwise direction and the size Lw of the lengthwise direction of the hole 7. Conditions were determined for obtaining characteristics in which the greatest magnetic power can be provided, (that is, demagnetization of the magnets seen up to the central frequency is the greatest), and the best insertion loss S21 is provided. The best conditions concerning the hole size were consequently found out as follows: (1) The extension of a projected planar form of the hole in the direction perpendicular to the main surfaces of the ferrite member needs to include the gap between the magnets via the ferrite assembly or the gap between the magnet and the magnetic block via the ferrite assembly, and (2) the extension of a projected planar form of the hole in the direction parallel to the main surfaces of the ferrite member needs to be equal to or greater than a range including the width of the ferrite member in the direction parallel to the main surfaces of the ferrite member. In other words, the hole needs to be provided such that when looking inside the hole from a distance, the entire ferrite member can be seen and the edges of the two magnets or the edges of the magnet and the magnetic block sandwiching the ferrite assembly can be seen.

Figure 13A:
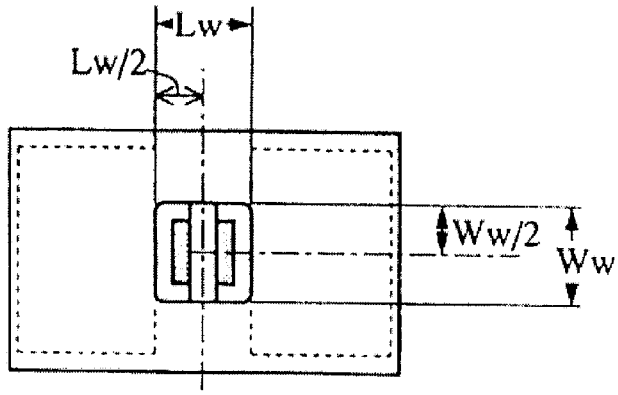
FIGS. 13A to 13D show the top views of isolators having holes of different sizes formed therein.
Figure 13B:
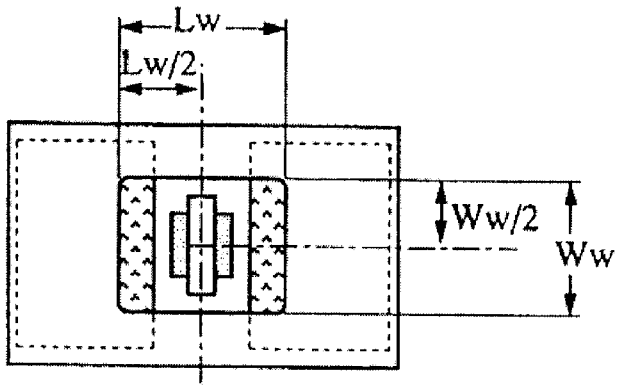
Figure 13C:
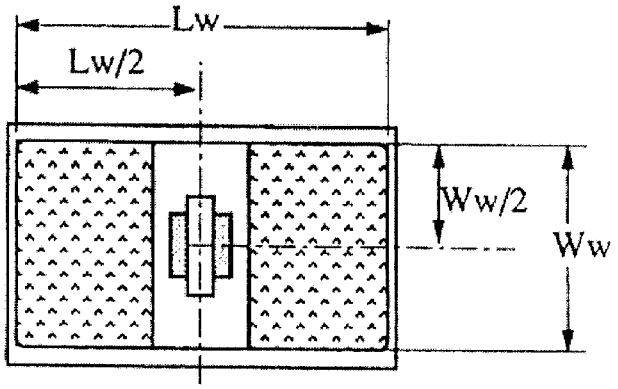
Figure 13D:
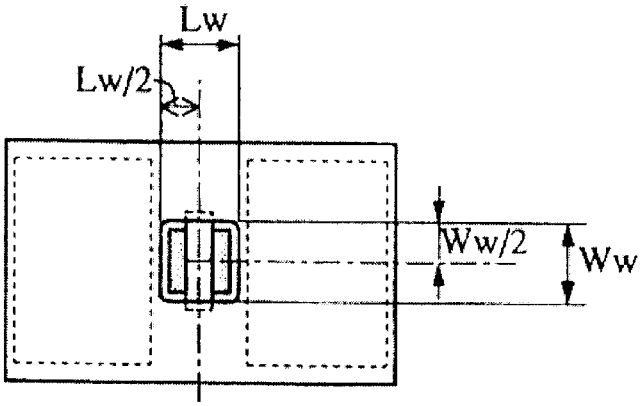

FIG. 13A shows an example in which the hole has the minimum size satisfying the above first and second conditions. FIG. 13C shows an example in which the hole has the maximum size satisfying those conditions. FIG. 13B shows an example in which the hole has an intermediate size, and FIG. 13D shows an example in which the hole has a size smaller than the minimum size satisfying the above conditions. In FIGS. 13A, 13B, and 13C, low insertion loss and high isolation characteristics can be obtained.

As shown in this embodiment, when the opening of the hole 7 has the substantially quadrangular shape, since the effect of arranging the yoke away from the ferrite assembly is increased, the opening area of the hole does not have to be widened.

Next, the structure of an isolator according to a seventh embodiment of the invention will be discussed with reference to FIG. 14A to FIG. 15B.

Figure 14A:
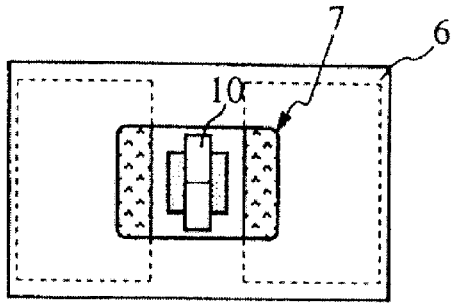
FIG. 14A shows a top view of an isolator according to a seventh embodiment of the invention and FIG. 14B shows a side view of the isolator.
Figure 14B:
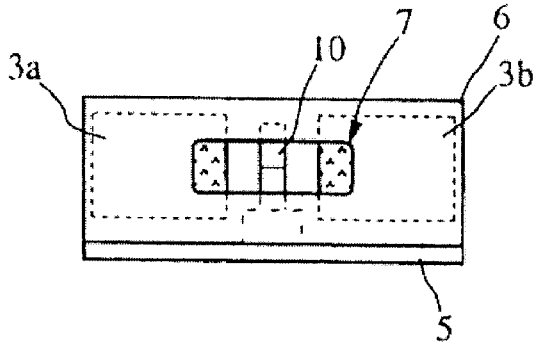
Figure 15A:
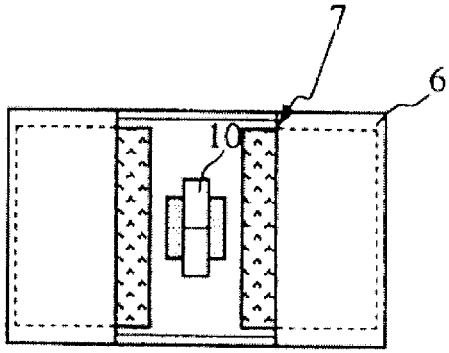
FIG. 15A shows a top view of another isolator according to the seventh embodiment and FIG. 15B shows a side view of the isolator.
Figure 15B:
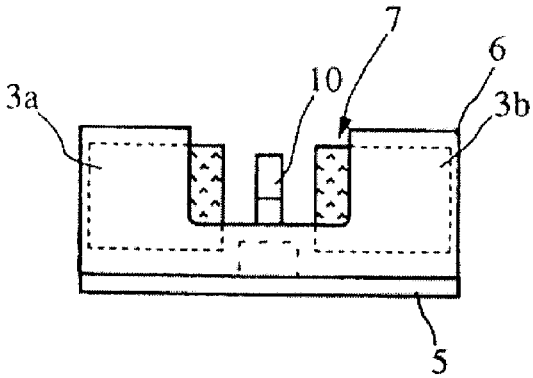

FIGS. 14A and 15A show top views of the isolator and FIGS. 14B and 15B show side views thereof. In FIGS. 14A and 14B, in addition to a hole 7 formed in the planar portion (top planar portion) parallel to a mounting substrate in a yoke 6 used as a case, another hole 7 is formed in a planar portion (side planar portion) perpendicular to the mounting substrate in the yoke 6. In each of FIGS. 15A and 15B, there is arranged a hole 7 continuing from the planar portion (top planar portion) parallel to a mounting substrate in a yoke 6 as a case to planar portions (side planar portions) perpendicular to the mounting substrate in the yoke 6.

With the above arrangement, since bending of a static magnetic field applied to the ferrite member can be prevented by isolating the yoke from the ferrite member, the electric characteristics does not deteriorate.

Next, the structure of an isolator according to an eighth embodiment of the invention will be discussed with reference to FIGS. 16A to 18B.

Figure 16A:
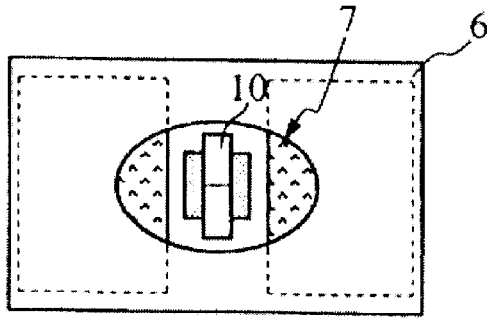
FIG. 16 shows a top view of an isolator according to an eighth embodiment of the invention.
Figure 16B:
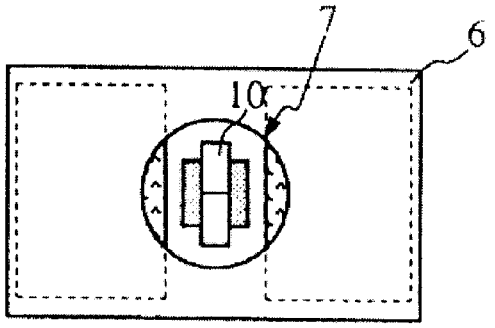

FIGS. 16A and 16B show the top views of two isolators. In FIG. 16A, the opening of a hole 7 is oblong. In FIG. 16B, the opening of a hole 7 is circular.

Figure 17A:
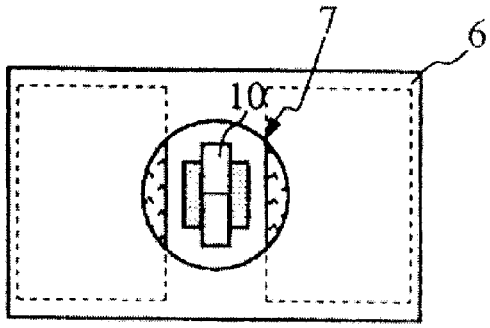
FIG. 17A shows a top view of another isolator according to the eighth embodiment and FIG. 17B shows a side view of the isolator.
Figure 17B:
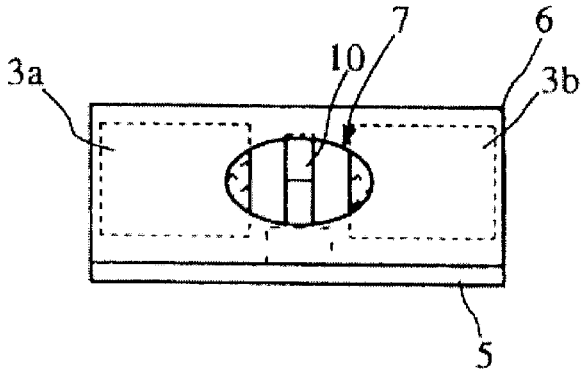
Figure 18A:
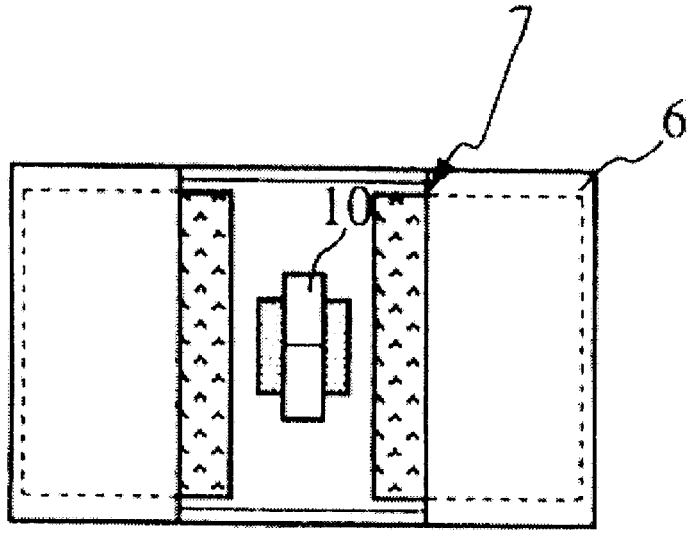
FIG. 18A shows a top view of another isolator according to the eighth embodiment and FIG. 18B shows a side view of the isolator.
Figure 18B:
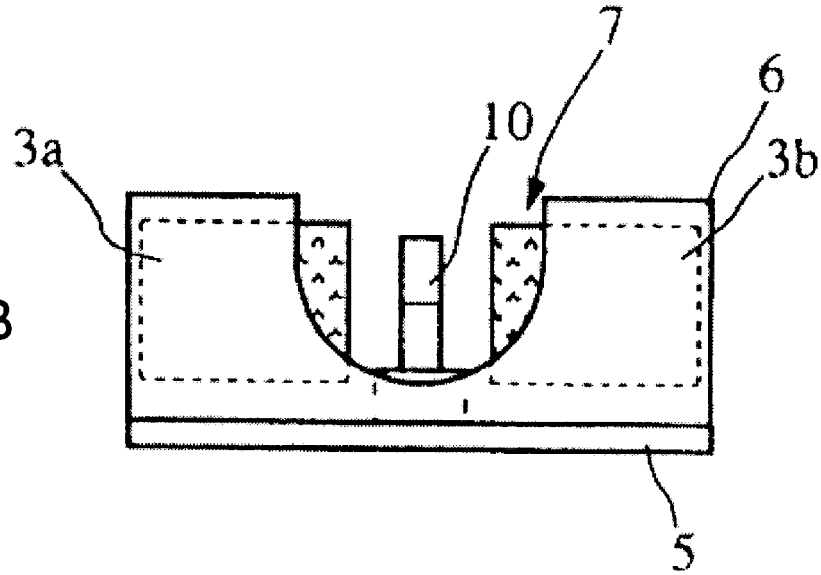
Figure 19A:
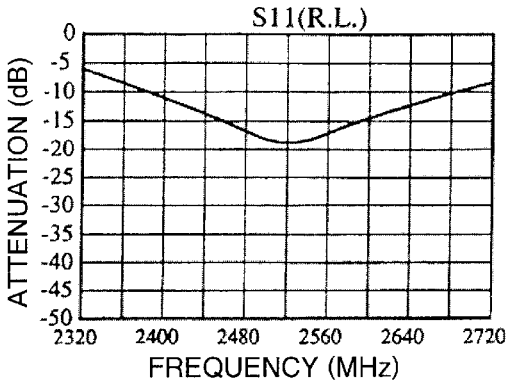
FIGS. 19A to 19D show graphs for illustrating the electric characteristics of an isolator according to a ninth embodiment of the invention.
Figure 19C:
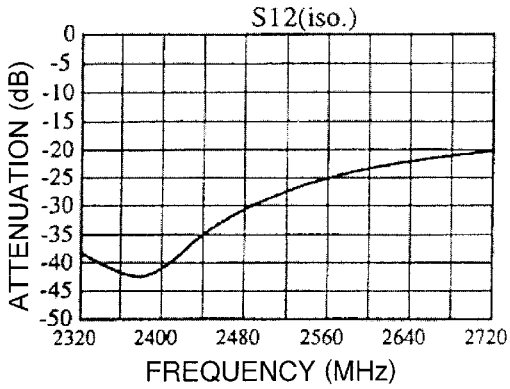
Figure 19B:
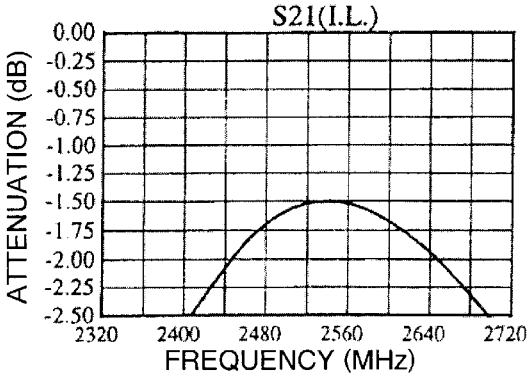
Figure 19D:
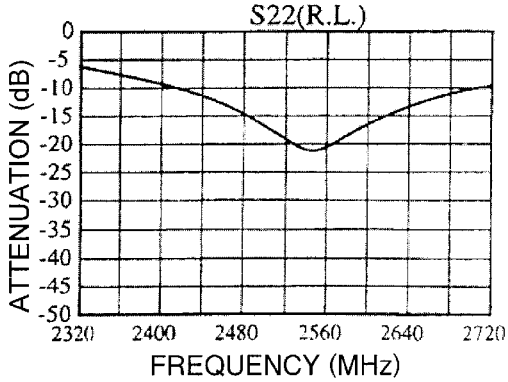

FIGS. 17A and 18A show the top views of isolators and FIGS. 17B and 18B show the side views of the isolators. In each of FIGS. 17A and 17B, an oblong or circular hole 7 is formed in each of the top and side surfaces of a yoke. In FIGS. 18A and 18B, there is formed a hole 7 continuing from the top surface of a yoke to the side surfaces thereof. The end faces of the hole formed on the side surfaces of the yoke are half-round.

In this manner, by making the entire hole 7 or part of the hole 7 oblong or circular, the rigidity of the yoke used as a case can be increased.

Next, the structure of an isolator according to a ninth embodiment of the invention will be discussed with reference to FIGS. 19A to 19D.

In each of the embodiments described above, the hole of the isolator has been illustrated only as a hole formed in the yoke used as the case. However, the hole may be covered with a nonmagnetic film. With this arrangement, the case can be more dust-proof and damp-proof.

In addition, into the yoke used as the case, a hard or soft insulation resin may be filled through the hole. In this case, since the yoke, the mounting substrate, the supporting base, the ferrite assembly, and the magnets are integrated with the resin, the case can be more dust-proof, damp-proof, and shock-proof.

FIGS. 19A to 19D show electric characteristics of the isolator obtained when the resin is filled. In this situation, the sizes of parts forming the isolator are the same as those shown in the sixth embodiment. The hole size is the same as the hole size shown in FIG. 13A.

As shown in these figures, even by filling the resin into the yoke, low insertion loss and high isolation characteristics can be obtained.

Figure 20:
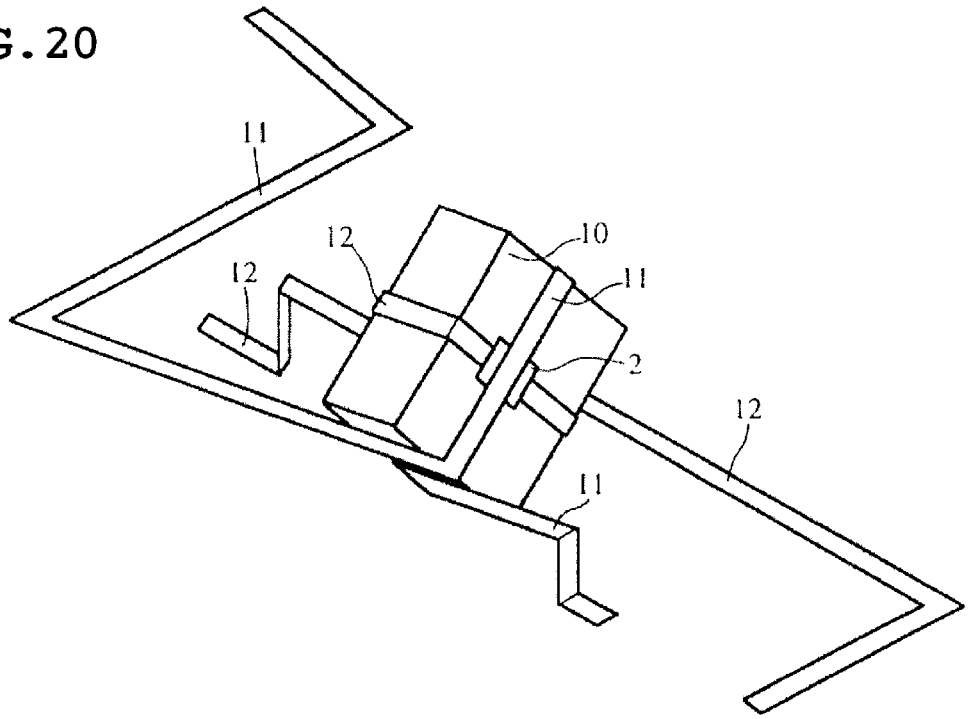
FIG. 20 shows a perspective view of a ferrite assembly used in an isolator according to a tenth embodiment of the invention.

Next, the structure of an isolator according to a tenth embodiment of the invention will be discussed with reference to FIG. 20.

In the above embodiments, the central conductors are metal wires whose surfaces are insulated. However, the central conductors of the invention may be formed by flat metal plates, that is, metallic foils. FIG. 20 shows an example of the ferrite assembly in this case. The reference numerals 11 and 12 are ribbon-like copper foils. A quadrangular ferrite plate 10 is wounded with the copper-foil ribbons 11 and 12. An insulation sheet 2 is interposed between the two overlapped central conductors 11 and 12 to electrically insulate the central conductors 11 and 12 from each other.

As an alternative to the insulation sheet 2, an insulated metal foil may be used.

As mentioned above, by using the metal foils as the central conductors, the thickness of the central conductors can be reduced. Thus, the entire ferrite assembly can be made thinner. As a result, the entire nonreciprocal circuit device can also be miniaturized.

Figure 21:
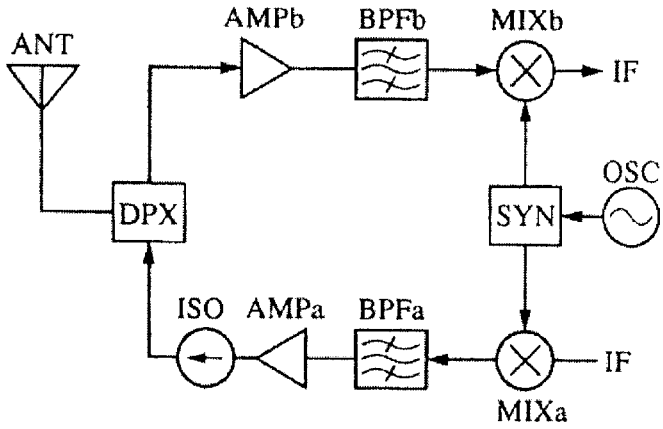
FIG. 21 shows a block diagram of a communication apparatus according to an eleventh embodiment of the invention.

Next, the structure of a communication apparatus according to an eleventh embodiment of the invention will be discussed with reference to FIG. 21. In FIG. 21, the reference character ANT denotes a transmission/reception antenna, the reference character DPX denotes a duplexer, the reference characters BPFa and BPFb denote band pass filters. The reference characters AMPa and AMPb denote amplifying circuits, the reference characters MIXa and MIXb are mixers, the reference character OSC denotes an oscillator, the reference character SYN denotes a frequency synthesizer, and the reference character ISO denotes an isolator.

The MIXa mixes an input IF signal with a signal output from the SYN. Of the mixed signals output from the MIXa, the BPFa passes only the signals of a transmission frequency band, and the AMPa amplifies the signals, which are transmitted from the ANT via the ISO and the DPX. The AMPb amplifies the reception signals output from the DPX. Of the reception signals output from the AMPb, the BPFb passes only the signals of a reception frequency band. The MIXb mixes the frequency signals output from the SYN with the reception signals to output intermediate frequency signals IF.

The isolator shown in FIG. 21 is the isolator having the above structure.

Thus, by using the isolator in which low insertion loss can be obtained and the reductions of size, height, and weight are achieved, the communication apparatus of the invention such as a mobile phone or the like can have entirely high power-consumption efficiency as a thinner and lightweight apparatus.

Figure 22:
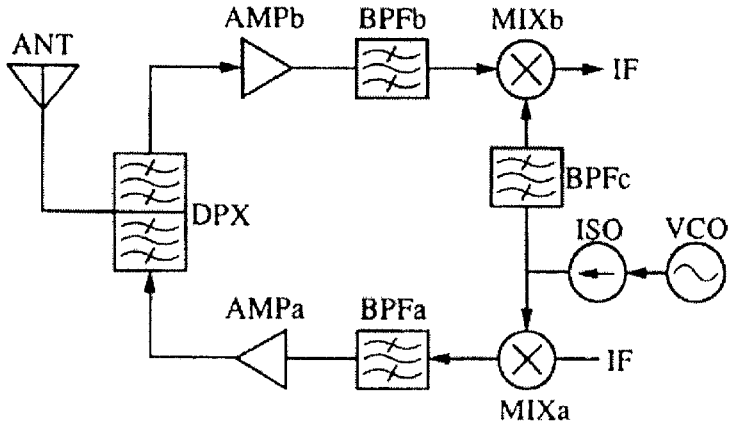
FIG. 22 shows a block diagram of a communication apparatus according to a twelfth embodiment of the invention.

Next, the structure of a communication apparatus according to a twelfth embodiment of the invention will be discussed with reference to FIG. 22. In FIG. 22, the reference character ANT denotes a transmission/reception antenna, the reference character DPX denotes a duplexer, the reference characters BPFa and BPFb denote band pass filters. The reference characters AMPa and AMPb denote amplifying circuits, the reference characters MIXa and MIXb are mixers, the reference character OSC denotes an oscillator, the reference character SYN denotes a frequency synthesizer, and the reference character ISO denotes an isolator.

Unlike the communication apparatus shown in FIG. 21, in this apparatus, the isolator ISO is arranged between a local VCO (voltage-controlled oscillator) and the mixer. A BPFc is arranged to pass only predetermined frequency signals of the local signals and send to the MIXb. The other structural parts are the same as those shown in the eleventh embodiment.

Conventionally, a buffer amplifier is arranged between the VCO and the mixer. However, as mentioned above, the isolator ISO is arranged between the VCO and the mixer to use as a buffer element. This isolator ISO is the isolator having the structure described above.

Since the isolator is a passive element, when the circuit is formed as mentioned above, power consumption can be lower than power consumption in the conventional case in which the buffer amplifier is arranged. Accordingly, entirely, the communication apparatus of the invention can have higher power-consumption efficiency, being an apparatus such as a compact and lightweight mobile phone.

As described above, in this invention, the thickness directions of the components included in the nonreciprocal circuit device are oriented toward the direction parallel to the main surface of the mounting substrate. Thus, without making the components thinner forcefully, the entire nonreciprocal circuit device can be miniaturized reducing the height.

In addition, even when small magnets are used, a desired static magnetic field can be applied to the ferrite member. Thus, the entire device can be made compact preventing deterioration of the electric characteristics.

In addition, since the bridging planar portion of the yoke forms substantially a plane shape, bending of the static magnetic field applied to the ferrite member is prevented. Thus, the deterioration of the electric characteristics can be prevented. Additionally, since the weight of the yoke is reduced, the entire device can be made lightweight and production cost can be reduced.

In addition, since the opening shape of the hole formed in the yoke is substantially quadrangular, the effect of prevention of the bending of the static magnetic field due to the hole can be increased by the small opening area.

In addition, the hole is formed in the yoke such that the extension of the planar-projection shape of the hole in the direction perpendicular to the main surfaces of the ferrite member includes the gap between the magnetic members or the gap between the magnet and the magnetic block via the ferrite assembly, and the extension of the planar-projection shape of the hole in the direction parallel to the main surfaces of the ferrite member includes the width of the ferrite member in the direction parallel to the main surfaces. With this arrangement, without making the opening of the hole larger than necessary, the effect of prevention of the bending of the static magnetic field due to the hole can be increased.

In addition, by using the hole to adjust the angle at which the central conductors of the ferrite assembly intersect each other, isolation characteristics can be adjusted. This arrangement can prevent deficiencies in isolation characteristics caused by changes of the intersecting angle occurring when soldering the yoke and the substrate later in the manufacturing process.

In addition, when the yoke is as a case and the hole formed in the yoke is coated with a non-magnetic film or the space inside the yoke is filled with a resin, the case can be more dust-proof, damp-proof, and shock-proof.

In addition, the invention can prevent circuitry opening caused by floating of the metal wires due to solder melting occurring when performing reflow-soldering and short circuiting of the metal wires to other parts.

In addition, the height of the device can be reduced by forming the cavity or the hole for fitting the ferrite assembly or each of the magnets into the bridging planar portion of the yoke and the substrate. Moreover, with the arrangement, the ferrite assembly and the magnets can be fixed easily inside the nonreciprocal circuit device. As a result, since no specific fixing member is needed, the entire device can be made compact.

In addition, the ferrite member is a polygonal planar shape with four or more sides. Thus, the central conductors can be wound and fixed easily.

Furthermore, the central conductors are metal wires having insulated surfaces and the ferrite member is wound with the metal wires to constitute the ferrite assembly. Thus, even when using a small ferrite member, since the inductances of the central conductors can be sufficiently obtained, the entire isolator can be miniaturized.

Furthermore, since the diameter of each metal wire is 0.1 mm or less, without deteriorating insertion loss characteristics, the device can be miniaturized.

Moreover, in this invention, by forming the central conductors by metallic foils, the ferrite assembly can be made thinner. Thus, the entire nonreciprocal circuit device can be made compact.

In addition, in this invention, when the two central conductors are used, one end of each central conductor being grounded while the other ends of the central conductors being connected to the input/output terminals or being connected to the electrodes of components connected to the input/output terminals, wider frequency band characteristics can be obtained.

Furthermore, in this invention, by setting the thickness of the yoke to be 0.2 mm or less, without reducing vibration resistance strength and fall-shock tolerance strength, the entire device can be miniaturized reducing its height.

Additionally, this invention can provide the entirely thin and lightweight communication apparatus such as a mobile phone or the like.

While preferred embodiments of the present invention have been described above, it is to be understood that various modifications and changes will be apparent to those skilled in the art without departing the spirit and scope of the invention.

What is claimed is:

1. A nonreciprocal circuit device comprising:

a plurality of central conductors mutually intersecting in an electrically insulated state;

a ferrite assembly including the central conductors and a ferrite member; and at least one magnet arranged for applying a static magnetic field to the ferrite member;

wherein main surfaces of the ferrite member and the at least one magnet are arranged perpendicularly to a mounting surface of a substrate which is part of the nonreciprocal circuit device.

2. A nonreciprocal circuit device according to claim 1, further comprising:

one of a pair of magnets and a set of a magnet and a magnetic member, wherein said one of the pair of magnets and the set of a magnet and a magnetic member are arranged such that a gap is formed between said one of the pair of magnets and the set of a magnet and a magnetic member and such that the ferrite assembly is sandwiched between said one of the pair of magnets and the set of a magnet and a magnetic member; and a yoke including at least one pair of contacting planar portions contacted with the external surfaces of said one of the pair of magnets and the set of a magnet and a magnetic member and at least one planar portion bridging the at least one pair of contacting planar portions.

3. A nonreciprocal circuit device according to claim 2, wherein the at least one bridging planar portion defines substantially a plane.

4. A nonreciprocal circuit device according to claim 2, wherein at least one hole is provided in the yoke, the hole being formed near the ferrite member.

5. A nonreciprocal circuit device according to claim 4, wherein the hole is provided in the planar portion of the yoke parallel to the mounting surface of the substrate.

6. A nonreciprocal circuit device according to claim 4, wherein the hole is provided in the planar portion of the yoke perpendicular to the mounting surface of the substrate.

7. A nonreciprocal circuit device according to claim 4, wherein the hole extends from the planar portion that is parallel to the mounting surface of the substrate to the planar portion that is perpendicular to the mounting surface of the substrate.

8. A nonreciprocal circuit device according to claim 4, wherein the hole defines a substantially quadrangular opening.

9. A nonreciprocal circuit device according to claim 4, wherein the hole is formed such that the dimension of a projected planar form of the hole in a direction perpendicular to the main surfaces of the ferrite member includes the gap between said one of the pair of magnets and the set of a magnet and a magnetic member, and the dimension of a projected planar form of the hole in a direction parallel to the main surfaces of the ferrite member includes the width of the ferrite member in the direction parallel to the main surfaces.

10. A nonreciprocal circuit device according to claim 4, wherein the yoke is used as a case and the hole is covered with a nonmagnetic film.

11. A nonreciprocal circuit device according to claim 4, wherein the yoke is used as a case and the yoke is filled with a resin.

12. A nonreciprocal circuit device according to claim 2, further comprising a cavity or a hole formed in the planar portion of the yoke which is parallel to the mounting surface of the substrate or in the substrate to fit the ferrite assembly or each magnet thereto.

13. A nonreciprocal circuit device according to claim 2, wherein the thickness of the yoke is 0.2 mm or less.

14. A nonreciprocal circuit device according to claim 1, wherein the central conductors are metal wires having electrically insulated surfaces, and the ferrite member is wound with the central conductors to constitute the ferrite assembly.

15. A nonreciprocal circuit device according to claim 14, wherein the diameter of each metal wire is 0.1 mm or less.

16. A nonreciprocal circuit device according to claim 1, wherein the central conductors are metallic foils and the ferrite member is wound with the central conductors to constitute the ferrite assembly.

17. A nonreciprocal circuit device according to claim 1 including two central conductors, one end of each of the conductors being grounded and the other ends of the conductors being connected to input/output terminals or components connected to the input/output terminals.

18. A nonreciprocal circuit device according to claim 1, wherein the ferrite member has a polygonal planar shape with four or more sides.

19. A communication apparatus comprising the nonreciprocal circuit device according to claim 1.

20. A nonreciprocal circuit device comprising:

a plurality of central conductors mutually intersecting each other;

a ferrite assembly including the central conductors and a ferrite member;

at least one magnet arranged for applying a static magnetic field to the ferrite member; and a housing including a substrate and containing the plurality of central conductors, the ferrite assembly, and the at least one magnet, wherein main surfaces of the ferrite member and the at least one magnet are arranged perpendicularly to a mounting surface of the substrate.

* * * * *